US007464652B2

(12) United States Patent
Hauck

(10) Patent No.: US 7,464,652 B2
(45) Date of Patent: Dec. 16, 2008

(54) FOLD-DOWN WALL-TABLE KNEE-BRACE

(76) Inventor: Robert F. Hauck, 180 Claremont Dr., Morgan Hill, CA (US) 95037

( * ) Notice: Subject to any disclaimer, the term of this patent is extended or adjusted under 35 U.S.C. 154(b) by 229 days.

(21) Appl. No.: 11/181,362

(22) Filed: Jul. 14, 2005

(65) Prior Publication Data

US 2006/0011106 A1 Jan. 19, 2006

Related U.S. Application Data

(60) Provisional application No. 60/588,215, filed on Jul. 15, 2004.

(51) Int. Cl.
*A47B 23/00* (2006.01)

(52) U.S. Cl. ..... 108/48; 108/42

(58) Field of Classification Search ..... 108/48, 108/47, 42, 80; 16/221, 319, 343, 344, 374
See application file for complete search history.

(56) References Cited

U.S. PATENT DOCUMENTS

| | | | | | |
|---|---|---|---|---|---|
| 145,614 | A | * | 12/1873 | Blom, Jr. | 108/48 |
| 687,031 | A | | 11/1901 | Jeffcott | |
| 859,454 | A | | 7/1907 | Larsson | |
| 1,111,151 | A | * | 9/1914 | Heartmann | 108/48 |
| 1,137,172 | A | * | 4/1915 | Stewart | 108/48 |
| 1,541,342 | A | | 6/1925 | Friel | |
| 2,483,899 | A | | 10/1949 | Grasso | |
| 2,843,436 | A | | 7/1958 | Franks | |
| 3,113,533 | A | * | 12/1963 | Snow | 108/134 |
| 3,242,882 | A | * | 3/1966 | Hoyt | 108/48 |
| 4,068,601 | A | | 1/1978 | Marsh | |
| 4,378,107 | A | | 3/1983 | Wagster | |
| 4,437,414 | A | | 3/1984 | Brescia | |
| 4,779,539 | A | * | 10/1988 | Stiglich | 108/48 |
| 4,789,123 | A | | 12/1988 | Mattsson | |
| 4,829,910 | A | * | 5/1989 | Lirette | 108/80 |
| 4,840,340 | A | | 6/1989 | Gustafsson | |
| 4,998,484 | A | | 3/1991 | Groetzinger | |
| 6,026,753 | A | * | 2/2000 | Sharpe | 108/48 |
| 7,254,869 | B2 | * | 8/2007 | You | 16/326 |

* cited by examiner

*Primary Examiner*—José V Chen
(74) *Attorney, Agent, or Firm*—Donald E. Schreiber

(57) ABSTRACT

A foldable knee-brace for support a table having an edge secured to a wall. The knee-brace includes first and second struts. The second strut includes a pair of parallel bars. Ends of the bars are disposed on opposite sides of an end of the first strut, and hinged thereto. Pockets formed into each bar's side surface are positionable adjacent to the first strut's end for receiving an end of a locking-pin carried at and projecting outward from the first strut's end. Ends of the first strut and second strut's bars furthest from the hinge are equipped for hinged fastening respectively to:

a. the table near a second edge thereof furthest from the wall; and
b. to the wall below the table's first edge.

Configured in this way, the knee-brace folds between the table and the wall when the table is collapsed adjacent to the wall.

12 Claims, 4 Drawing Sheets

FOLD-DOWN WALL-TABLE KNEE-BRACE

CLAIM OF PROVISIONAL APPLICATION RIGHTS

This application claims the benefit of U.S. Provisional Patent Application No. 60/588,215 filed on Jul. 15, 2004.

BACKGROUND

1. Technical Field

The present improvement relates to collapsible table constructions, and more specifically to such tables which are secured along one edge to a wall or other support to project outward therefrom and are adapted to be placed into a collapsed orientation against the wall.

2. Description of Background Art

A need exists for supporting a loaded 32-inch wide wall-mounted fold-down table which minimizes interference with access to the erected table. There exist support hinges for legs of free-standing tables, but those legs, which are attached to the table with such hinges, stand vertically when the legs are in the opened position supporting the table. Configured in this way, such table legs obstruct foot space below the opened table. Furthermore, while there exist commercially available hinges for supporting a collapsible shelf from a wall, such hinges possess limited weight-bearing capacity. Therefore, such hinges are useful only for shelves up to approximately 14 inches wide. These shelf-hinges are usually made of metal with a locking mechanism at the hinge-pin. This hinge configuration cannot support a heavy load because torque induced at the hinge-pin by a loaded shelf can easily exceed the bending threshold of a metal stop which supports the shelf in the locked configuration.

Over the years various solutions have been developed for supporting collapsible wider shelves and tables from a wall or other support. Common characteristics shared by various solutions include fastening one edge of the table to a wall or other support by conventional hinges. These hinges permit the wide shelf or table to be raised to a horizontal orientation in which it projects outward from the wall or other support. Such hinges also permit the table to be lowered to an orientation with the table collapsed against the wall.

Another common characteristic shared by various solutions for supporting a collapsible wide shelf or table is an elongated two-piece brace which, when extended, spans between an upper attachment along an edge of the table furthest from the wall, and a lower attachment to the wall or support below hinges securing the table thereto. When disposed in this position, the brace forms one side of a triangle with the table and the wall or support forming the other two sides of the triangle. In these solutions, opposite ends of the two-piece brace are secured by various hinge constructions to the edge of the table and to the wall. The solutions also exhibit various constructions for coupling together adjacent ends of the two piece brace at a location along the brace's length between the table's edge and the wall or other support. These two-piece braces also employ differing structures for locking them in their table supporting configuration. Brace locking structures may be broadly classified into those which are located at an end of the extended brace, and those which are located about the middle of the brace.

U.S. Pat. No. 4,068,601 entitled "Folding Table Construction" ("the 601 patent") discloses a folding brace which has a locking structure located at the brace's upper end. The folding brace includes upper and lower struts both of which have a channel or U-shaped cross-section in which a web spans between a pair of side flanges. A pin secures a top end of the upper strut to the table at the edge thereof which is furthest from a hinge securing the table to the wall. A pin also secures a bottom end of the lower strut to the wall or support below the hinge. A pair of pins, each of which respectively spans between a side flange of the wider lower strut and a side flange of the narrower upper strut, join together ends of the upper and lower struts about the middle of the brace. The channel or U-shaped lower strut is wider than the upper strut for receiving one end of the upper strut when the brace is in its extended linear configuration, and substantially the entire upper strut when the brace is folded for storing the table against the wall. When the table is in its raised horizontal orientation, a coil spring-loaded latch member, moveable longitudinally within the upper strut, engages a stop member that is located at the edge of the table which is furthest from a hinge securing the table to the wall.

U.S. Pat. No. 4,378,107 entitled "Workpiece Support and Clamping Assembly" discloses a folding brace having a locking structure located at the brace's upper end. A rivet located about the middle of the brace provides a simple pivot that joins together opposite ends of the two piece brace. The locking structure located at the brace's upper end includes an over-center locking-means, and a self-actuating locking means. The locking structure also includes release levers for releasing the locking means. When the brace is locked in its extended position, it may be collapsed inwardly into a folded storage position only by actuating its release lever. The disclosed locking structure precludes the brace's collapse by jarring the hinges.

U.S. Pat. No. 4,437,414 entitled "Folding Table for Wall Mounting" ("the '414 patent") also discloses a folding brace having a locking structure located at the brace's upper end. Each brace includes an elongated lower support strut pivotally connected to a wall bracket. A shorter upper locking strut connects pivotally between the end of the lower strut furthest from the wall bracket and the edge of the table. The locking strut pivots inwardly and upwardly from an intermediate linear configuration of both struts to engage the underside of the table resting thereon when in the table is in its raised, horizontal orientation. In the collapsed position, the brace's struts rotate outwardly from both the table and the wall to fold between the wall and the vertically oriented table.

U.S. Pat. No. 4,998,484 entitled "Versatile Wall Mount Folding Table" discloses a folding brace which has a locking structure located at the brace's lower end which is the complement of that disclosed in the '414 patent. Each brace includes an elongated upper support strut pivotally connected to the edge of the table. A shorter lower locking strut connects pivotally between the end of the upper strut furthest from the table's edge and a wall bracket. The locking strut pivots inwardly and backwardly from an intermediate linear configuration of both struts to contact the wall when in the table is in its raised, horizontal orientation. In the collapsed position, the brace's struts rotate outwardly from both the table and the wall to fold between the wall and the vertically oriented table. Varying the vertical distance separating the upper hinge, which secures the table's edge to the wall, from the lower wall bracket, to which the lower strut connects, permits the table's surface to slope rather than being horizontal thereby adapting the surface for use in drafting.

U.S. Pat. No. 687,031 entitled "Folding Brace" discloses a brace having a locking structure located about the middle thereof. The brace's lower strut is forked along most of its length furthest from the wall to receive a lower end of the upper strut located furthest from the table's edge. This forked end of the lower strut carries a pivot therebetween which includes a friction-roller. The friction-roller passes through and engages a cam-opening which pierces the adjacent lower end of the upper strut. A catch which is fastened to the lower end of the upper strut engages the forked upper end of the lower strut, and operates in conjunction with the pivot and the friction-roller for automatically locking the brace in its extended, substantially linear configuration. In the collapsed configuration, the struts respectively fold toward the table and the wall with the upper strut resting within the forked end of the lower strut.

U.S. Pat. No. 859,454 entitled "Bracket" discloses a folding brace that also has a locking structure located about the middle of the brace. Specifically, the brace's locking structure includes a plate that spans across the width of the brace's upper strut. The locking structure also includes flanges which curve around and enclose the upper strut's opposite longitudinal edges. Configured in this way, when the strut is disposed in its substantial linear configuration the locking structure slides downward along the lower end of the brace's upper strut to engage the lower strut's upper end with the lower strut's opposite longitudinal edges received into the curved flanges. Portions of the curved flanges about the middle thereof which extend further across the struts' widths engage a hinge which joins the lower end of the upper strut to the upper end of the lower strut. Thus, the extended portions of the flanges prevent the locking structure from sliding further down the lower strut when the table is locked in its horizontal orientation.

U.S. Pat. No. 1,541,342 entitled "Combination Ironing Board and Serving Table" also discloses a locking structure located about the middle of a two-piece brace. When configured for use as a serving table, a pivot joins the lower end of the upper strut to the upper end of the lower strut. A stop, formed as part of the upper strut engages the lower strut to retain the struts in a linear configuration.

U.S. Pat. No. 2,483,899 entitled "Collapsible Shelf" also discloses a locking structure located about the middle of a two-piece brace. The brace's upper strut has a U-shaped cross-section. A pin secures a top end of the upper strut to the edge of the table furthest from hinges securing the table to the wall. The lower end of the upper strut includes a cam surface which includes a filler block that spans between opposite sides of the U-shaped strut. The upper strut's cam surface includes a retaining notch. Two parallel lengths of material disposed respectively on opposite sides of the U-shaped upper strut form the lower strut. These two parallel lengths of material at their ends nearest the upper strut are held apart from each other by a locking bolt. Elongated longitudinal apertures pierce each of the parallel lengths of material forming the lower strut near its juncture with the upper strut. Each of the elongated longitudinal apertures respectively receives one end of a pivot pin which passes through the U-shaped upper strut to extend outward on both sides thereof. When the strut is locked in its linear configuration, the portion of the locking bolt which extends between the two parallel lengths of material is received into the cam surface's retaining notch. Helical springs which engage the material forming the lower strut at its attachment to the wall apply a torque to the lower strut which urges it to remain in the brace's linear configuration with the locking bolt received into the cam surface's retaining notch.

U.S. Pat. No. 2,843,436 entitled "Wall Mounted Folding Table" ("the '436 patent") and U.S. Pat. No. 3,115,533 entitled "Locking and Unlocking Folding Brace" ("the '533 patent") each respectively disclose similar folding braces having a locking structure located about the middle of the brace. Channel or U-shaped upper and lower struts of the braces respectively disclosed in the '436 and '533 patents have structures which are substantially the same as those of the upper and lower struts disclosed previously for the '601 patent. However, the braces disclosed respectively by the '436 and '533 patents omit the upper strut's latch and stop members disclosed for the '601 patent. Also, the braces disclosed respectively by the '436 and '533 patents replace the pair of pins, each of which respectively spans between a side flange of the wider lower strut and a side flange of the narrower upper strut, with a single pin that spans between both side flanges of the wider lower strut for joining together the upper and lower struts' adjacent ends about the middle of the brace. Longitudinal slots that pierce both of the wider lower strut's side flanges respectively receive the opposite ends of the pin that project outward from the narrower upper strut's side flanges. Near the pin that joins together the upper and lower struts, the upper strut's web carries a latch member or cleat thereby creating a gap on the upper strut which is adapted to receive the adjacent end of the lower strut's web. When the table is raised to its horizontal orientation which places the two struts in a linear configuration, sliding the lower strut's web into the gap created by the latch member or cleat locks the brace in its extended configuration.

All of the braces described above appear to be made of metal. Presently, a solid plastic, wood-alternative material made from 100% recycled polyethylene plastic obtained from soda bottles, detergent bottles, and milk containers is available from a number of different manufacturers. This solid plastic, wood-alternative material is strong, impact resistant, and "wood-like" in appearance. Furthermore, this material is maintenance free, and needs no painting or superficial maintenance. Similar to wood, the solid plastic, wood-alternative material can be cut, drilled, mitered, routered, and sanded with conventional woodworking tools.

One characteristic of the solid plastic, wood-alternative material, in comparison with most types of natural wood used in fabricating outdoor architectural structures is that it has slightly less mechanical rigidity. However, because in many instances mechanical requirements of structures are moderate or may be accommodated by an appropriate design or hidden structural supports, the solid plastic, wood-alternative material's lesser mechanical rigidity does not prevent its use in such structures.

BRIEF SUMMARY

An object of the present disclosure is to provide a collapsible table that is usable either indoors and outdoors.

Yet another object of the present disclosure is to provide a simple knee-brace for a collapsible table.

Yet another object of the present disclosure is to provide a durable knee-brace for a collapsible table.

Yet another object of the present disclosure is to provide a cost-effective knee-brace for a collapsible table.

Yet another object of the present disclosure is to provide a knee-brace for a collapsible table which is easily maintained.

Yet another object of the present disclosure is to provide a knee-brace for a collapsible table which is economical to manufacture.

Briefly, in one aspect the present disclosure is a knee-brace that is adapted for supporting a table that has a first edge secured to a wall. Secured to the wall, the table is orientable to extend outward from the wall, and also orientable to a collapsed orientation in which the table is vertical and parallel to the wall. The knee-brace includes a first strut and a second strut. The second strut includes a pair of parallel bars. An end of each of the parallel bars is respectively disposed on opposite sides of an end of the first strut, and joined to the first strut by a strut hinge. Each of the bars respectively has a pocket formed into a side surface of the bar. The pockets are positionable adjacent to the end of the first strut. The pockets are adapted for receiving an end of a locking-pin which is carried at the end of the first strut and projects outward from opposite sides of the first strut. Ends of the first strut and of the bars of the second strut which are located furthest from the strut hinge and the locking-pin respectively are equipped with hinges that are fastenable respectively to:

a. the table near a second edge thereof which is furthest from the wall when the table is oriented to extend outward from the wall; and b. to the wall below the first edge of the table. Configured in this way, the knee-brace folds between the table and the wall when the table is oriented to the collapsed orientation.

Another aspect the present disclosure is a collapsible table that is adapted for being secured to a wall by a first edge. The collapsible table is orientable to extend outward from the wall, and orientable to a collapsed orientation in which the table is adjacent to the wall. When oriented to extend outward from the wall, the collapsible table is supported by at least one knee-brace of the type described above.

An advantage of the present disclosure is a knee-brace configuration that can easily support a 200 lb load on the outer edge of a 32-inch wide hinged shelf or collapsible table.

Another advantage of the disclosed knee-brace is that it is readily fabricated, preferably, from high-density solid plastic and hidden stainless-steel pins and hinge-brackets both for strength and for durability in outdoor applications.

These and other features, objects and advantages will be understood or apparent to those of ordinary skill in the art from the following detailed description of the preferred embodiment as illustrated in the various drawing figures.

DETAILED DESCRIPTION

Figure 1:
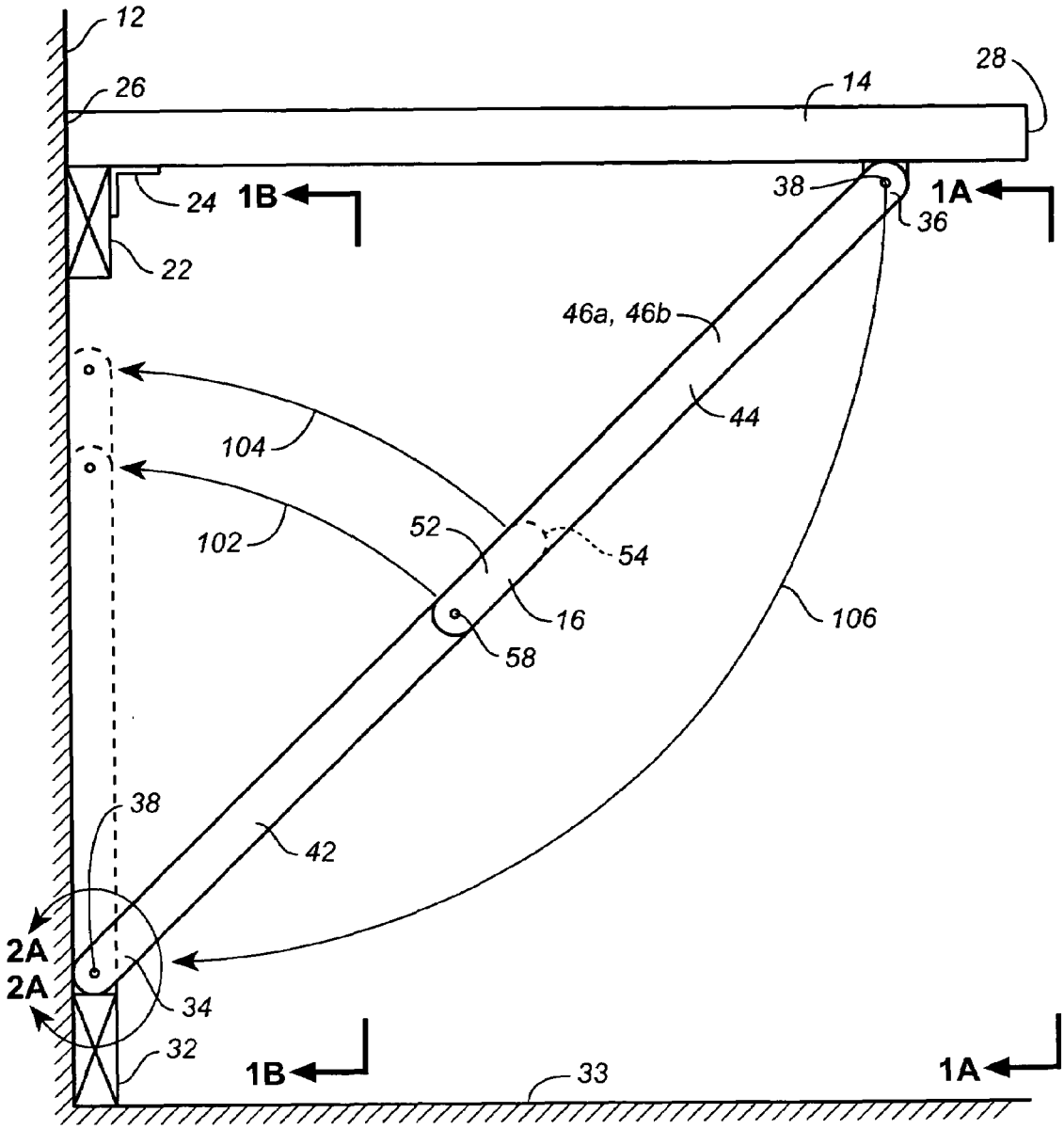
FIG. 1 is an elevational view depicting a side view of a wall with a table secured to the wall by hinges and projecting therefrom, the table being supported about its edge furthest from the wall by a knee-brace in accordance with the present disclosure, the knee-brace being formed by an upper and a lower strut.
Figure 1A:
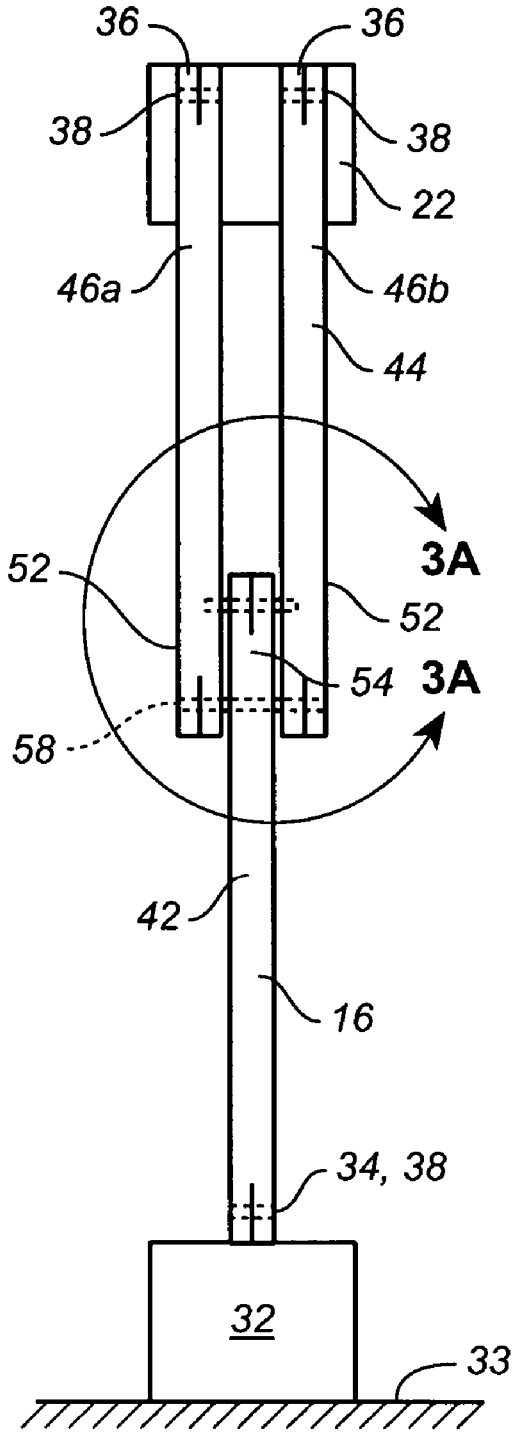
FIG. 1A is an elevational view taken along the line 1A-1A in FIG. 1 depicting the knee-brace supporting the table.
Figure 1B:
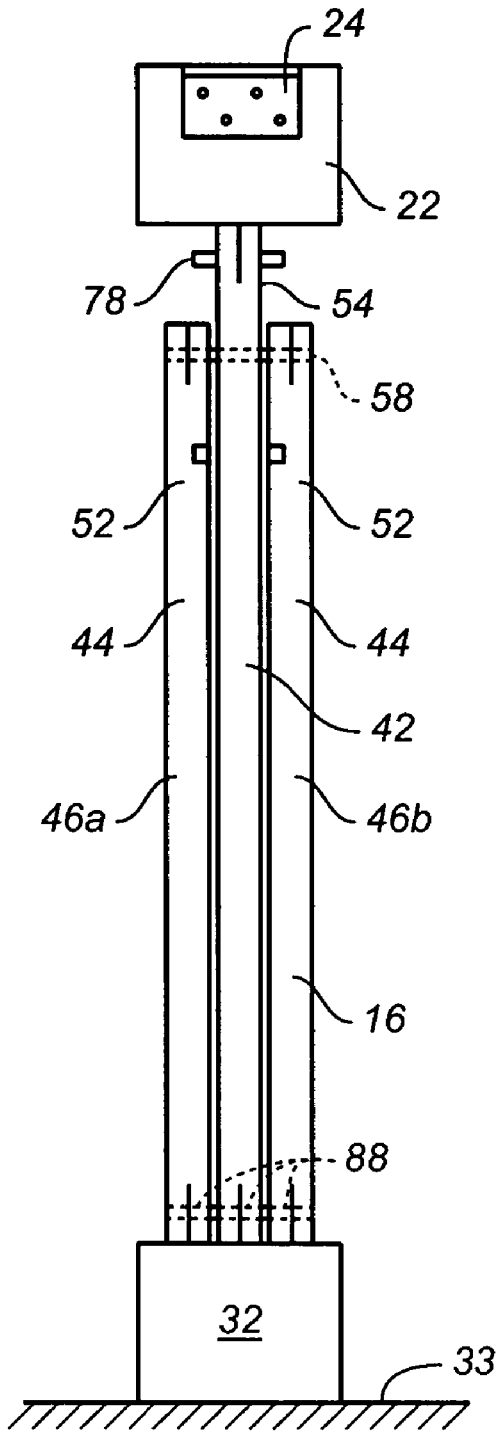
FIG. 1B is an elevational view taken along the line 1B-1B in FIG. 1 depicting the knee-brace folded when the table is collapsed against the wall.

FIG. 1 illustrates a side view of a wall 12, a table 14, and a knee-brace 16 of the present disclosure. In FIG. 1, the knee-brace 16 supports the table 14 in a horizontal orientation in which the table 14 projects outward from the wall 12 or other support. FIG. 1A is a front view depicting the knee-brace 16 supporting the table 14 when raised to a horizontal orientation projecting outward from the wall 12 or other support. FIG. 1B is also a front view that, however, depicts the knee-brace 16 when the table 14 has been lowered to an orientation in which the table 14 is collapsed against the wall 12.

Immediately beneath the table 14 where it abuts the wall 12, a top-block 22 is fastened to the wall 12, with a conventional butterfly-hinge 24 being fastened both to the table 14 and to the top-block 22. The table 14 is preferably hinged to the top-block 22 so a back-edge 26 of the table 14 aligns flush with the wall 12 when the table 14 is raised to a horizontal orientation. Configured in this way, the top-block 22 restricts any further upward movement of a front-edge 28 of the table 14 upon its becoming oriented horizontally. While FIG. 1 depicts only a single top-block 22 and butterfly-hinge 24 securing the table 14 to the wall 12, preferably two (2) or more pairs of top-blocks 22 and butterfly-hinges 24 separated laterally along the back-edge 26 of the table 14 secure the table 14 to the wall 12.

A base-block 32 is fastened to the wall 12 beneath the top-block 22 and immediately above a floor 33. The knee-brace 16, both at a lower-end 34 and at an upper-end 36, is preferably fastened by pin-hinges 38, respectively, to the base-block 32 adjacent to the wall 12, and to the table 14 near its front-edge 28. A preferred pin-hinge 38 is described in greater detail below. While FIG. 1 depicts only a single base-block 32 and knee-brace 16, preferably two (2) or more pairs of base-blocks 32 and knee-braces 16, preferably equal in number to the number of the top-blocks 22 and butterfly-hinges 24, are used for supporting the table 14 when raised to a horizontal orientation. Such pairs of base-blocks 32 and knee-braces 16 are preferably separated laterally along the wall 12 coincident with pairs of top-blocks 22 and butterfly-hinges 24.

Each knee-brace 16 includes a lower strut 42, and an upper strut 44. Each upper strut 44 includes two (2) parallel bars 46*a*, 46*b*. The bars 46*a*, 46*b* include lower ends 52 that are respectively disposed along opposite sides of an upper end 54 of the one-piece lower strut 42. The lower strut 42 provides the lower-end 34 of the knee-brace 16 which, as described previously, is fastened to the wall 12 by the pin-hinge 38. As better illustrated in FIGS. 3A and 3B, both lower ends 52 of the upper struts 44 are fastened to the upper end 54 of the lower strut 42 by a strut hinge-pin 58 passing completely therethrough. The strut hinge-pin 58 preferably has a diameter of ⅜ of an inch. Slots 62, respectively cut into the lower end 52 of each of the bars 46*a*, 46*b*, respectively receive a hinge-pin retaining washer 64. Each of the washers 64 is pierced by a hole through which the strut hinge-pin 58 passes. The washers 64 are preferably 1.5 inches diameter, 3/32 of an inch thick, and the hole piercing each of them is preferably 0.003inches smaller in diameter than the diameter of the strut hinge-pin 58. Such a hole piercing the washers 64 provide a tight fit which clamps and retains the strut hinge-pin 58.

Similar to the lower ends 52, a slot 72 is cut into the upper end 54 of the lower strut 42 to receive a lock-pin retaining washer 74. A locking-pin 76, having a diameter equal to and a length shorter than that of the strut hinge-pin 58, passes through a hole piercing the washer 74 to extend through and project outward from both sides of the lower strut 42. The washer 74 is preferably identical to the previously described washers 64. The bars 46*a*, 46*b* are shaped identically except that pocket 78, formed into one side of each bars 46*a*, 46*b* to receive the locking-pin 76 carried by the lower strut 42, is cut into the side of the bars 46*a*, 46*b* respectively facing the lower strut 42. The pockets 78 are respectively carved into the bars 46*a*, 46*b* slightly more than halfway across their width. By making the depth of the pockets 78 for the locking-pin 76 slightly more than halfway through the thickness of each bars 46*a*, 46*b*, when the table 14 is raised to a horizontal orientation with the locking-pin 76 disposed in the bottom of the pockets 78, the knee-brace 16 orients itself obliquely to and slightly beyond a linear alignment. Disposing the knee-brace 16 in this position locks the knee-brace 16 under any downward force applied to the table 14 including the weight of the cantilevered table 14.

Figure 2A:
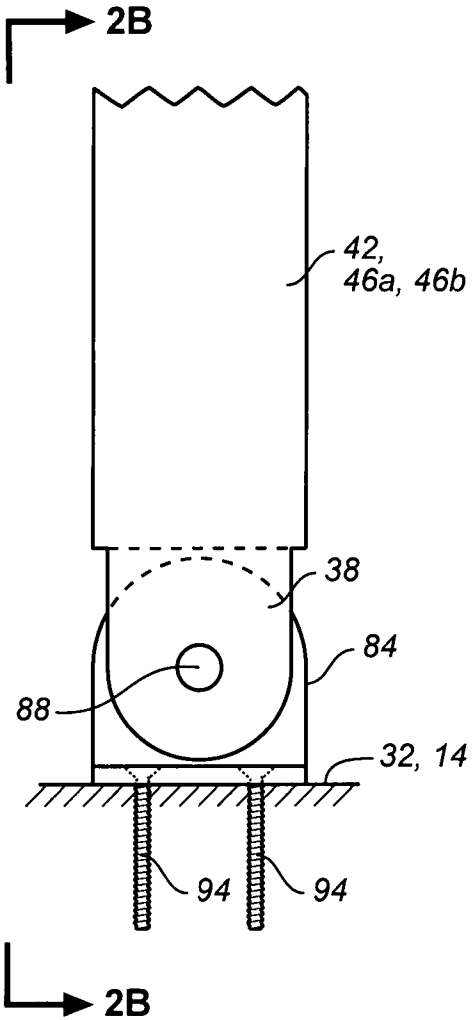
FIG. 2A is an elevational view taken along the line 2A-2A in FIG. 1 depicting a pinned hinge that is preferably used for securing an end of a strut included in the knee-brace both to the wall and to the table.
Figure 2B:
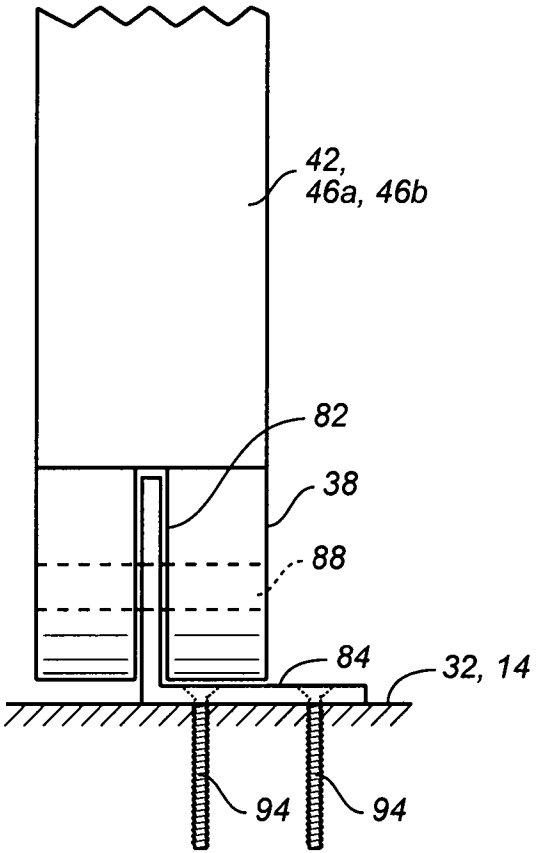
FIG. 2B is an elevational view taken along the line 2B-2B in FIG. 2A also depicting the preferred pinned hinge.
Figure 2C:
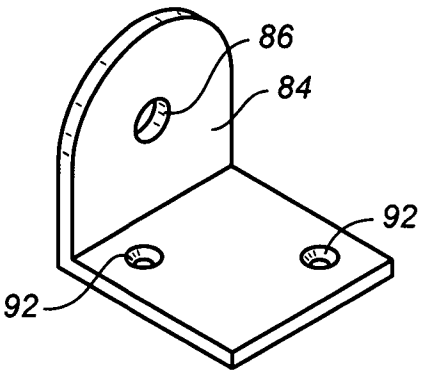
FIG. 2C is a perspective view depicting a hinge bracket included in the preferred pinned hinge depicted in FIGS. 2A and 2B.

The bars 46*a*, 46*b* provide the upper-end 36 of the knee-brace 16 each of which, as described previously, is fastened to the table 14 by pin-hinges 38. FIGS. 2A and 2B illustrate, generically, the preferred pin-hinge 38 located both at the lower-end 34 and upper-end 36 of the knee-brace 16. At each pin-hinge 38, similar to the upper end 54 of the lower strut 42 and to the lower ends 52 of the bars 46*a*, 46*b*, a pin-hinge slot 82 is cut into the lower-end 34 of the lower strut 42, and respectively into both upper-ends 36 of the bars 46*a*, 46*b*. The pin-hinge slot 82 preferably receives one-half of an L-shaped hinge bracket 84 best illustrated in FIG. 2C. The hinge bracket 84 is preferably made from 3/32 inch thick sheet material to extend approximately 1.5 inches into the pin-hinge slot 82, and 1.5 inches along the base-block 32 or along the table 14. A central hole 86 pierces that half of the hinge bracket 84 which extends into the pin-hinge slot 82. The central hole 86 is preferably 0.003 inches smaller in diameter than the diameter of a hinge-pin 88. Preferably, the hinge-pin 88 extends completely through the lower-end 34 of the lower strut 42, and respectively completely through each upper-end 36 of the bars 46*a*, 46*b*. The hinge-pin 88 preferably has a diameter of 3/8 of an inch and a length equal respectively to the width of the lower strut 42 and of the bars 46*a*, 46*b*. The portion of the hinge bracket 84 which extends along the wall 12 is pierced by a pair of mounting-screw holes 92 which, as illustrated in FIGS. 2A and 2B, respectively receive wood screws 94 for securing the hinge bracket 84 to the base-block 32 or to the table 14.

Because the knee-brace 16 is intended for use outdoors as well as indoors, all of its metallic parts, i.e. the pins 58, 76, 88, the washers 64 and 74, the hinge brackets 84, and the wood screws 94, are preferably made of stainless steel. Non-metallic portions of the knee-brace 16, i.e. the lower strut 42 and the bars 46*a*, 46*b* of the upper strut 44, are all preferably made from 1.5-inch thick solid polyethylene high-density plastic. This material provides strength sufficient for long-term performance of the slots 62, 72 and 82, and of the pockets 78. Because the lower strut 42 and the bars 46*a*, 46*b* are preferably 1.5-inch thick, the blocks 22 and 32 are also preferably 1.5-inch thick. Because of the top-block 22 offsets the butterfly-hinge 24 approximately 1.5 inches away from the wall 12, the table 14 in its linear configuration is inclined at an angle of approximately 42° with the wall 12, not 45° degrees as might be anticipated.

Configured in this way, while the table 14 is being collapsed against the wall 12 the knee-brace 16 folds at its midpoint with the lower end 52 of the upper strut 44 and the upper end 54 of the lower strut 42 traveling toward the wall 12 along paths indicated by curved arrows 102 and 104 in FIG. 1. When the table 14 collapses against the wall 12, as indicated by the curved arrow 106 the upper-end 36 of the knee-brace 16 abuts the lower-end 34 thereof with the two (2) parallel bars 46*a*, 46*b* of the upper strut 44 sandwiching the lower strut 42 as best illustrated in FIG. 1B. In this folded configuration, the hinge-pins 88 at the upper-end 36 of the knee-brace 16 preferably become aligned colinearly with the hinge-pin 88 at the lower-end 34 of the knee-brace 16. In this folded configuration, both the lower strut 42 and upper strut 44 become oriented vertically against the wall 12, and both the strut hinge-pin 58 and the pocket 78 come to rest immediately, but not coincidentally, below the top-block 22.

While supporting the table 14, the thicknesses of the hinge-pins 88, the strut hinge-pin 58 and the locking-pin 76 together with the thickness of the lower strut 42 and the bars 46*a*, 46*b* allow a significant force to be applied to the table 14 before the knee-brace 16 begins to bend sideways and fail. Overlapping of lower ends 52 of the bars 46*a*, 46*b* on both sides of the upper end 54 of the lower strut 42 also reinforces the knee-brace 16 from bending sideways and failing.

Assembly

Two (2) hinged knee-braces 16 are preferably used to support one table 14. One knee-brace 16 is located near each end of the table 14 being indented about 8 inches from the ends of the table 14.

The hinge brackets 84 are first screwed to the underside of the table 14 at near the front-edge 28 of the table 14, and to the base-block 32. For each knee-brace 16, on the underside of the table 14 near the front-edge 28, two hinge brackets 84 with their holes 92 against the table 14 are preferably oriented facing each other and spaced 1/8 inch apart. With the hinge brackets 84 positioned in this way, the central holes 86 nearest each other are separated by a distance of approximately 3.0 inches. A third hinge bracket 84 is fastened to the base-block 32 with the central hole 86 centered atop the base-block 32.

Along the back-edge 26 the table 14, two top-blocks 22 are preferably fastened to the underside of the table 14 with conventional stainless-steel butterfly-hinges 24 that are preferably placed in centered alignment with the hinge brackets 84 that are secured near the front-edge 28 of the table 14.

Figure 3A:
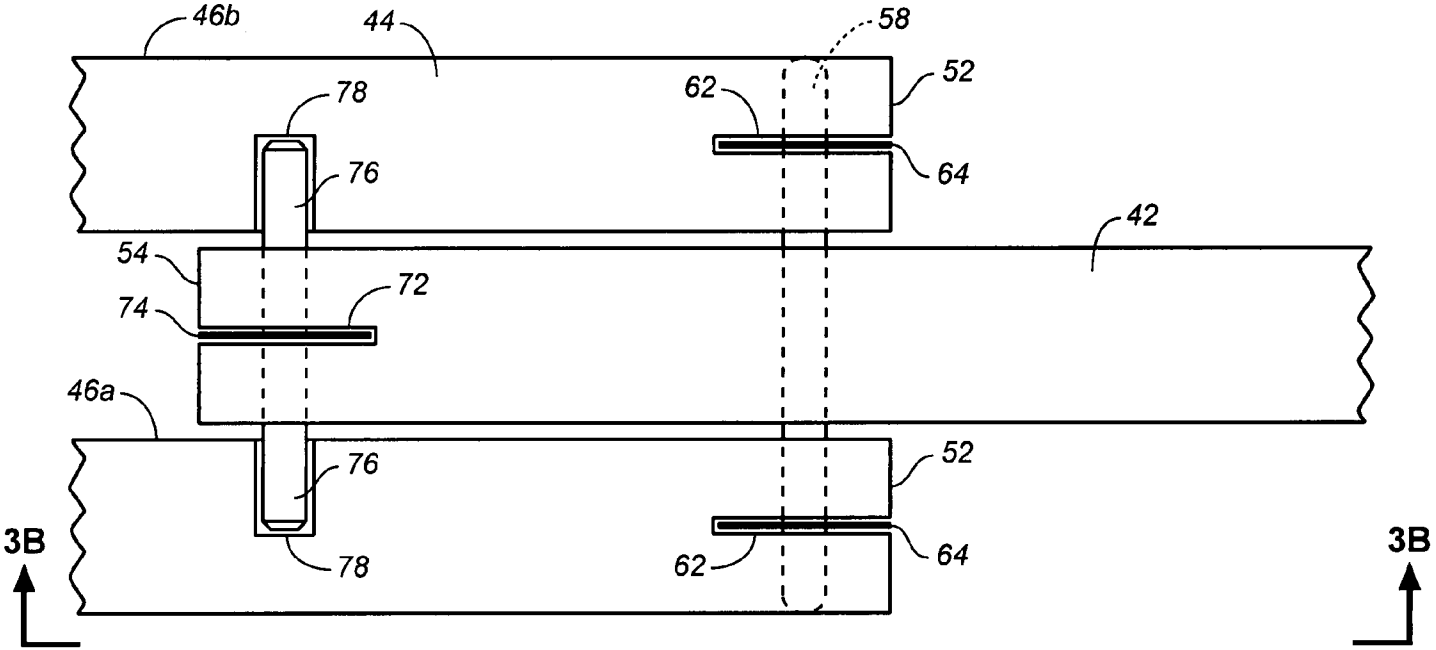
FIG. 3A is a elevational view taken along the line 3A-3A in FIG. 1A depicting a juncture between two struts included in the knee-brace.
Figure 3B:
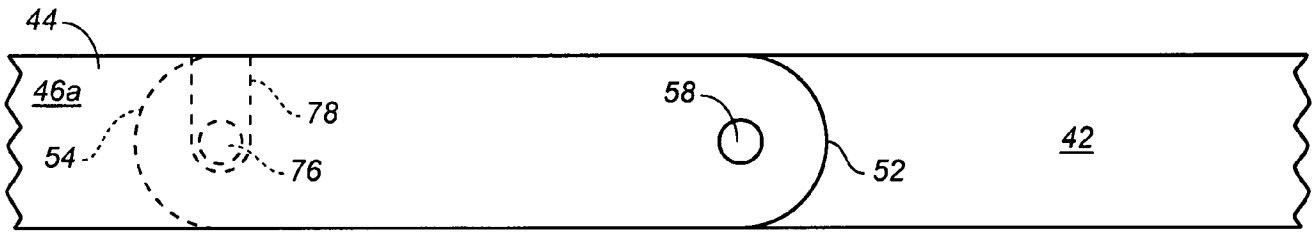
FIG. 3B is a elevational view taken along the line 3B-3B in FIG. 3A depicting the juncture between two struts included in the knee-brace.

Before mounting the knee-braces 16 to the hinge brackets 84, the lower strut 42 and the bars 46*a*, 46*b* are assembled together as illustrated in FIGS. 3A and 3B. The bars 46*a*, 46*b* are identical except for the opposing pockets 78 formed into the inside of each bars 46*a*, 46*b*to receive the locking-pin 76 carried at the upper end 54 of the lower strut 42. First, the bars 46*a*, 46*b* are fastened to the lower strut 42 by the strut hinge-pin 58, with the strut hinge-pin 58 being locked in place by the washers 64. Then, the locking-pin 76 is secured to the upper end 54 of the lower strut 42 by the washer 74.

After all knee-braces 16 have been assembled, the lower-end 34 and the upper-end 36 of each knee-brace 16 is placed on their respective hinge brackets 84, and the hinge-pin 88 is driven through each hinge bracket 84. This fastens the knee-brace 16 to both the table 14 and the base-block 32.

The table 14 is then prepared for fastening to the wall 12 by inserting bolts both through the top-blocks 22 and through the base-blocks 32. The base-blocks 32 are each then fastened to the wall 12 first. With the base-blocks 32 secured to the wall 12, then the table 14 is configured in its horizontal orientation projecting outward from the wall 12, and with the knee-braces 16 straight and locked. Finally, top-blocks 22 are fastened to the wall 12 thereby finishing assembly of table 14.

To collapse the table 14 to its vertical orientation, both knee-braces are bumped toward the wall 12 with the handler's knee and the table 14 falls to the collapsed position of its own weight. To raise the table 14 into its horizontal orientation, the handler grabs the front-edge 28 of the table 14, or one of its ends, and pulls the table 14 up into the horizontal orientation until no further movement is possible. The knee-braces 16 automatically lock into position when the locking-pins 76 respectively reach the bottom of the pockets 78 carved into the bars 46*a*, 46*b*.

Although the present invention has been described in terms of a preferred embodiment, it is to be understood that such disclosure is purely illustrative and is not to be interpreted as limiting. For example, FIG. 1 depicts the lower strut 42 being fastened to the base-block 32 and the bars 46*a*, 46*b* being fastened to the table 14. This particular orientation for the knee-brace 16 simplifies the path in FIG. 1 traversed by the upper end 54 of the lower strut 42 carrying the locking-pin 76 as indicated by the curved arrow 104 in that diagram. It is equally preferred, and perhaps even more preferred, for the knee-brace 16 to be reversed with the bars 46*a*, 46*b* fastened to the base-block 32, and the lower strut 42 fastened to the table 14. Furthermore, installed in either orientation the knee-brace 16 of the present disclosure takes up the same configuration upon collapsing the table 14 to its vertical orientation parallel to the wall 12. Consequently, without departing from the spirit and scope of the disclosure, various alterations, modifications, and/or alternative applications will, no doubt, be suggested to those skilled in the art after having read the preceding disclosure. Accordingly, it is intended that the following claims be interpreted as encompassing all alterations, modifications, or alternative applications as fall within the true spirit and scope of the disclosure including equivalents thereof. In effecting the preceding intent, the following claims shall:

1. not invoke paragraph 6 of 35 U.S.C. § 112 as it exists on the date of filing hereof unless the phrase "means for" appears expressly in the claim's text;
2. omit all elements, steps, or functions not expressly appearing therein unless the element, step or function is expressly described as "essential" or "critical;"
3. not be limited by any other aspect of the present disclosure which does not appear explicitly in the claim's text unless the element, step or function is expressly described as "essential" or "critical;" and
4. when including the transition word "comprises" or "comprising" or any variation thereof, encompass a non-exclusive inclusion, such that a claim which encompasses a process, method, article, or apparatus that comprises a list of steps or elements includes not only those steps or elements but may include other steps or elements not expressly or inherently included in the claim's text.

What is claimed is:

1. A knee-brace that is capable of supporting a table which:
a. has a first edge secured to a wall; and
b. is capable of being disposed in:
i. a raised configuration in which the table extends outward from the wall; and
ii. a collapsed configuration in which the table is disposed adjacent to the wall with the knee-brace folded between the table and the wall, the knee-brace comprising:
a first strut and a second strut:
a. said first strut carrying a locking-pin which is:
i. located at an end of said first strut; and
ii. projects outward from opposite sides of said first strut; and
b. said second strut including a pair of parallel bars:
i. an end of each of the parallel bars being respectively:
1) disposed on opposite sides of said first strut about the end thereof which carries the locking-pin: and
2) joined to the first strut by a strut hinge;
ii. each of the parallel bars respectively having a pocket formed into a side surface thereof, each of which pockets are capable of:
1) being positioned adjacent to the end of the first strut when the first and second struts rotate appropriately with respect to the strut hinge; and
2) receiving one of opposite ends of the locking-pin, ends of said first strut and of the parallel bars of said second strut that are furthest from the strut hinge and the locking-pin respectively having hinges that are capable of being fastened respectively to:
c. the table near a second edge thereof which is furthest from the wall when the table is configured to extend outward from the wall; and
d. the wall below the first edge of the table.

2. The knee-brace of claim 1 wherein the end of said first strut which carries the locking-pin has a slot formed therein, the slot receiving a washer that is pierced by a hole through which the locking-pin passes.

3. The knee-brace of claim 1 wherein the strut hinge which joins together the end of said first strut and the ends of the bars of said second strut includes a hinge-pin which extends completely through said first strut and into adjacent ends of both of the bars of said second strut.

4. The knee-brace of claim 3 wherein ends of the bars of said second strut into which the hinge-pin extends respectively have a slot formed therein, each slot receiving a washer that is pierced by a hole through which one end of the hinge-pin passes.

5. The knee-brace of claim 1 wherein hinges that are located at the end of said first strut and at the ends of the bars of said second strut, which ends are all located furthest from the strut hinge which joins together said first strut and said second strut and from the locking-pin, are formed by:
a pin-hinge slot formed:
a. into the end of said first strut located furthest from the strut hinge which joins together said first strut and said second strut and from the locking-pin; and
b. into each end of the bars of said second strut that are located furthest from the strut hinge which joins together said first strut and said second strut and from the locking-pin;
hinge brackets equal in number to the pin-hinge slots, each hinge bracket being respectively received into one of the pin-hinge slots, and each hinge bracket being pierced by a hole; and
hinge-pins equal in number to the pin-hinge slots, one hinge-pin being included in the end of said first strut and being respectively included in the ends of the bars of said second strut, which ends are all located furthest from the strut hinge which joins together said first strut and said second strut and from the locking-pin, each hinge-pin respectively passing through the hole that pierces the hinge bracket respectively received into each pin-hinge slot.

6. The knee-brace of claim 5 wherein when the table is in the collapsed configuration, the hinge-pins respectively passing through each hole that pierces the hinge bracket respectively received into the pin-hinge slots are aligned substantially colinearly.

7. A collapsible table comprising:
a. a table that is capable of being:
i. secured to a wall along a first edge thereof; and
ii. disposed in:
1) a raised configuration in which the table extends outward from the wall; and 2) a collapsed configuration in which the table is disposed adjacent to the wall; and b. at least one knee-brace which includes a first strut and a second strut:

i. said first strut carrying a locking-pin which is:

1) located at an end of said first strut; and 2) projects outward from opposite sides of said first strut; and ii. said second strut including a pair of parallel bars:

1) an end of each of the parallel bars being respectively:

A) disposed on opposite sides of said first strut about the end thereof which carries the locking-pin: and B) joined to the first strut by a strut hinge;

2) each of the parallel bars respectively having a pocket formed into a side surface thereof, each of which pockets are capable of:

A) being positioned adjacent to the end of the first strut when the first and second struts rotate appropriately with respect to the strut hinge; and B) receiving one of opposite ends of the locking-pin, ends of said first strut and of the parallel bars of said second strut that are furthest from the strut hinge and the locking-pin respectively having hinges that are capable of being fastened respectively to:

iii. the table near a second edge thereof which is furthest from the wall when the table is configured to extend outward from the wall; and iv. the wall below the first edge of the table, whereby when the table is in the collapsed configuration the knee-brace becomes folded between the table and the wall.

8. The collapsible table of claim 7 wherein the end of said first strut of said knee-brace which carries the locking-pin has slot formed therein, the slot receiving washer that is pierced by a hole through which the locking-pin passes.

9. The collapsible table of claim 7 wherein the strut hinge which joins together the end of said first strut and the ends of the bars of said second strut of said knee-brace includes a hinge-pin which extends completely through said first strut and into adjacent ends of both of the bars of said second strut.

10. The collapsible table of claim 9 wherein ends of the bars of said second strut of said knee-brace into which the hinge-pin extends respectively have a slot formed therein, each slot receiving a washer that is pierced by a hole through which one end of the hinge-pin passes.

11. The collapsible table of claim 7 wherein hinges that are located at the end of said first strut of said knee-brace and at the ends of the bars of said second strut of said knee-brace, which ends are all located furthest from the strut hinge which joins together said first strut and said second strut and from the locking-pin, are formed by:

a pin-hinge slot formed:

a. into the end of said first strut located furthest from the strut hinge which joins together said first strut and said second strut and from the locking-pin; and b. into each end of the bars of said second strut that are located furthest from the strut hinge which joins together said first strut and said second strut and from the locking-pin;

hinge brackets equal in number to the pin-hinge slots, each hinge bracket being respectively received into one of the pin-hinge slots, and each hinge bracket being pierced by a hole; and hinge-pins equal in number to the pin-hinge slots, one hinge-pin being included in the end of said first strut and being respectively included in the ends of the bars of said second strut, which ends are all located furthest from the strut hinge which joins together said first strut and said second strut and from the locking-pin, each hinge-pin respectively passing through the hole that pierces the hinge bracket respectively received into each pin-hinge slot.

12. The collapsible table of claim 11 wherein when the table is in the collapsed configuration, the hinge-pins of said knee-brace respectively passing through each hole that pierces the hinge bracket respectively received into the pin-hinge slots are aligned substantially colinearly.

* * * * *